US006146292A

United States Patent [19]

Yamanaka

[11] Patent Number: 6,146,292

[45] Date of Patent: Nov. 14, 2000

[54] THROWING GOOD FOR USE IN SKY DIVING

[76] Inventor: Atsushi Yamanaka, 4-31-13, Midori-cho, Tokorozawa-shi, Saitama-Ken, Japan

[21] Appl. No.: 09/260,012

[22] Filed: Mar. 2, 1999

[51] Int. Cl.[7] ..... A63B 65/00

[52] U.S. Cl. ..... 473/569; 473/594; 473/581

[58] Field of Search ..... 473/593, 594, 473/569, 578, 587; 273/360, 361, 365

[56] References Cited

U.S. PATENT DOCUMENTS

| | | | |
|---|---|---|---|
| 3,415,520 | 12/1968 | Woodward | 273/360 |
| 4,135,559 | 1/1979 | Barnby | 273/365 |
| 5,514,023 | 5/1996 | Warner | 473/594 |
| 5,538,456 | 7/1996 | Liu et al. | 473/594 |
| 5,836,842 | 11/1998 | McLearan | 473/581 |

*Primary Examiner*—Steven Wong
*Attorney, Agent, or Firm*—Oblon, Spivak, McClelland, Maier & Neustadt, P.C.

[57] ABSTRACT

A throwing good for use in sky diving, including a thin-gage, synthetic resin-made back body, a roughly circular opening window, a needle, a front body, and ballast water. The back body has a bottom and a cylindrical shape. The bottom has a small hole which can be opened and closed at will by means of a plug. The opening window is provided on the wall close to the front opening of the back body. The needle is directed toward the opening window protruded from the inner wall confronting the opening window. The front body has the same diameter as that of the back body of which back opening has a tip shaped into a hemisphere. The back opening of the front body is joined to the front opening of the back body and the joining portion is integrated by covering it with a rubber band of broad width capable of covering even the opening window. The ballast water fills the front body.

1 Claim, 5 Drawing Sheets

THROWING GOOD FOR USE IN SKY DIVING

FIELD OF THE INVENTION

This invention relates to a good used in sky diving, and more particularly to a safe throwing good used in the process of free fall in the sky diving.

DESCRIPTION OF THE ART

In sky diving, a person shouldering a folded parachute leaps down from a flying airplane and carries out various maneuvers during several tens seconds of free falling time, and it is known as an exciting sport. Although the time period of free fall varies according to the height from which the person leaps, the time period is about 50 seconds in a case where the person begins a free fall from a height of 12,500 feet and opens the parachute at a height of 3,000 feet from the ground surface. During the free fall, the person can perceive a sense of no-gravity-like feeling which cannot absolutely be felt in the daily life, and after repeated exercise, the person becomes able to control his posture and falling speed at will to link together hands between falling divers or even to keep a desired formation. Accordingly, one of the pleasures of sky divers is to attempt various maneuvers in the process of free fall. In the recent time, there is an attempt to catch a thrown good such as a ball between separate sky divers, which is called "sky ball". When a body is thrown in the process of free falling motion, the behavior of the body is entirely different from that on the ground, and it is quite difficult to throw a body to a desired direction, and it is also quite difficult to catch a body approaching himself. This fact stimulates sky divers, and sky ball seems to become popular as a pleasure of sky diving. The good to be thrown, tennis ball or the like of which falling speed is made close to that of human being by filling the ball with lead grains has been used usually. In sky diving, the diver manually opens the shouldered parachute when he has reached a prescribed height (usually 3,000 feet) to get ready for landing. When the sky diver is carrying out "sky ball", he is under an obligation to capture and recover the thrown matter before opening the parachute for the sake of preventing its fall onto the ground surface. However, the diver may fail to catch the sky ball, and in such a case the throwing good will collide against the ground surface at a considerably high speed. If a human being is in that point, he will suffer a fatal damage. Thus, some of the establishments for sky diving (drop zones) prohibit the use of such throwing goods. In order to avoid this type of danger, there is an attempt to prepare a throwing good which automatically projects a parachute at a predetermined height and thereby reduces its falling speed and can land with safety, even if sky diver fails to catch it. This can be realized easily by providing a mechanism of automatically projecting a parachute in linkage with a timer and a manometer. But, such a mechanism is so expensive that many of sky divers who are not affluent economically cannot use it daily. Further, in such costly goods, there is a danger that a sky diver who has failed to catch it does not abandon the catching work but may pursue the throwing good until he enters a dangerous zone lower than the minimum allowable height for opening parachute; As a result, of which the diver loses the time for parachute opening and crashes against ground surface. Accordingly, it is indispensably necessary for this sort of throwing goods to be inexpensive and disposable without grudge. Thus, it is an object of this invention to solve the above-described problem of sky ball by providing a throwing good which is simple in structure, available inexpensively and so excellent in safety that, even if a sky diver fails to catch it in the process of free fall, it automatically disintegrates at a predetermined height into light-weight bodies flutteringly falling and doing no harm to human being on the surface of the ground.

SUMMARY OF THE INVENTION

This invention relates to a throwing good for use in sky diving which includes a thin-gage, synthetic resin-made back body, a roughly circular opening window, a needle, a front body, and ballast water. The back body has a bottom and a cylindrical shape. The bottom has a small hole which can be opened and closed at will by means of a plug. The opening window is provided on the wall close to the front opening of the back body. The needle is directed toward the opening window protruded from the inner wall confronting the opening window. The front body has the same diameter as that of the back body of which back opening has a tip shaped into a hemisphere. The back opening of the front body is joined to the front opening of the back body and the joining portion is integrated by covering it with a rubber band of broad width capable of covering even the opening window. The ballast water fills therein.

When the throwing good not caught by sky diver free-falls down to a prescribed height (for instance, 2,000 feet), the rubber band joining the front and back bodies is broken by the needle due to the difference in pressure between the inner and outer atmospheres, due to which the front body separates from the back body, the water filled in the throwing good is released into air, and the throwing good becomes a safe, light-weight body flutteringly falling onto the surface of the ground.

DETAILED DESCRIPTION OF THE PREFERRED EMBODIMENT

Figure 1:
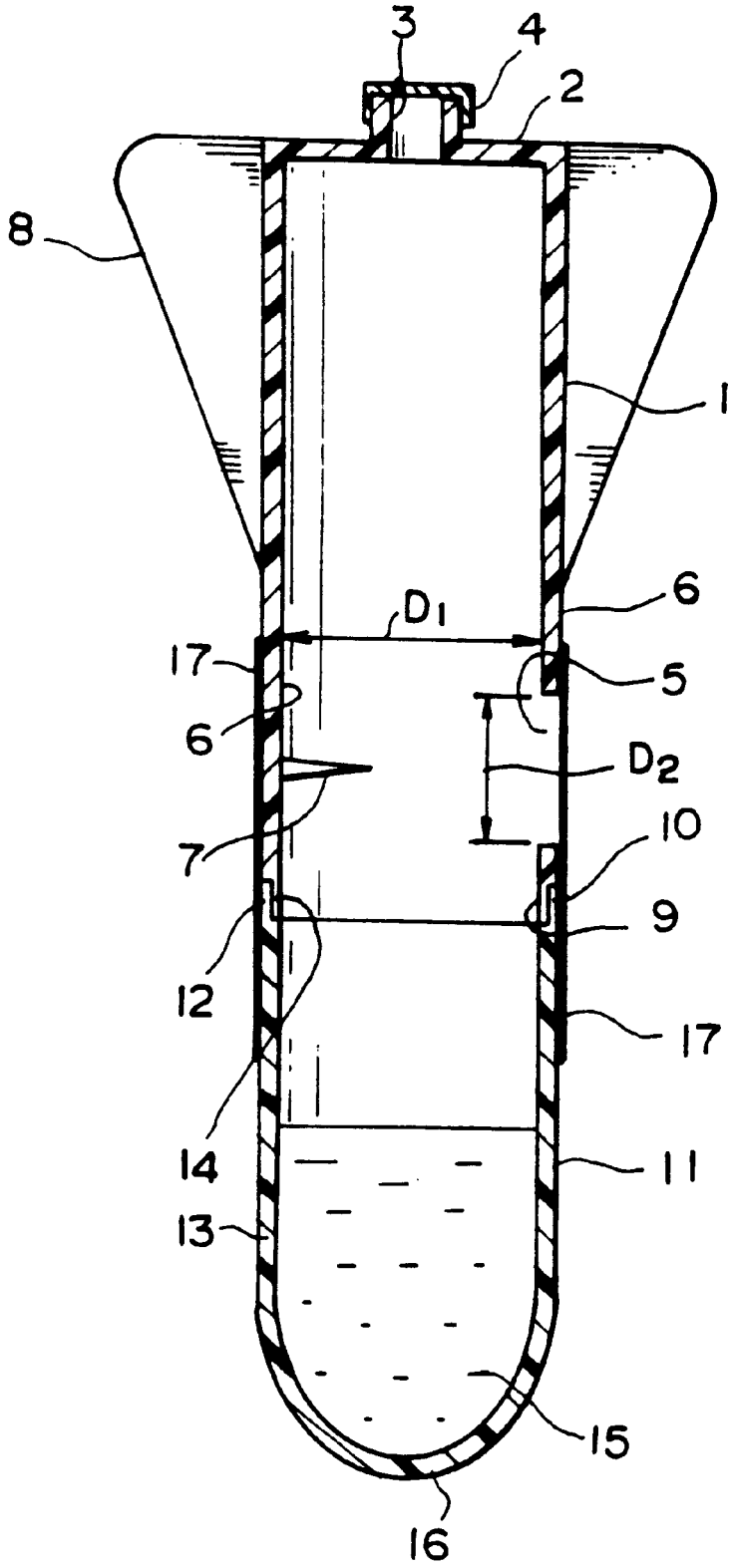
FIG. 1 is a longitudinal sectional view of one embodiment of this invention.
Figure 2:
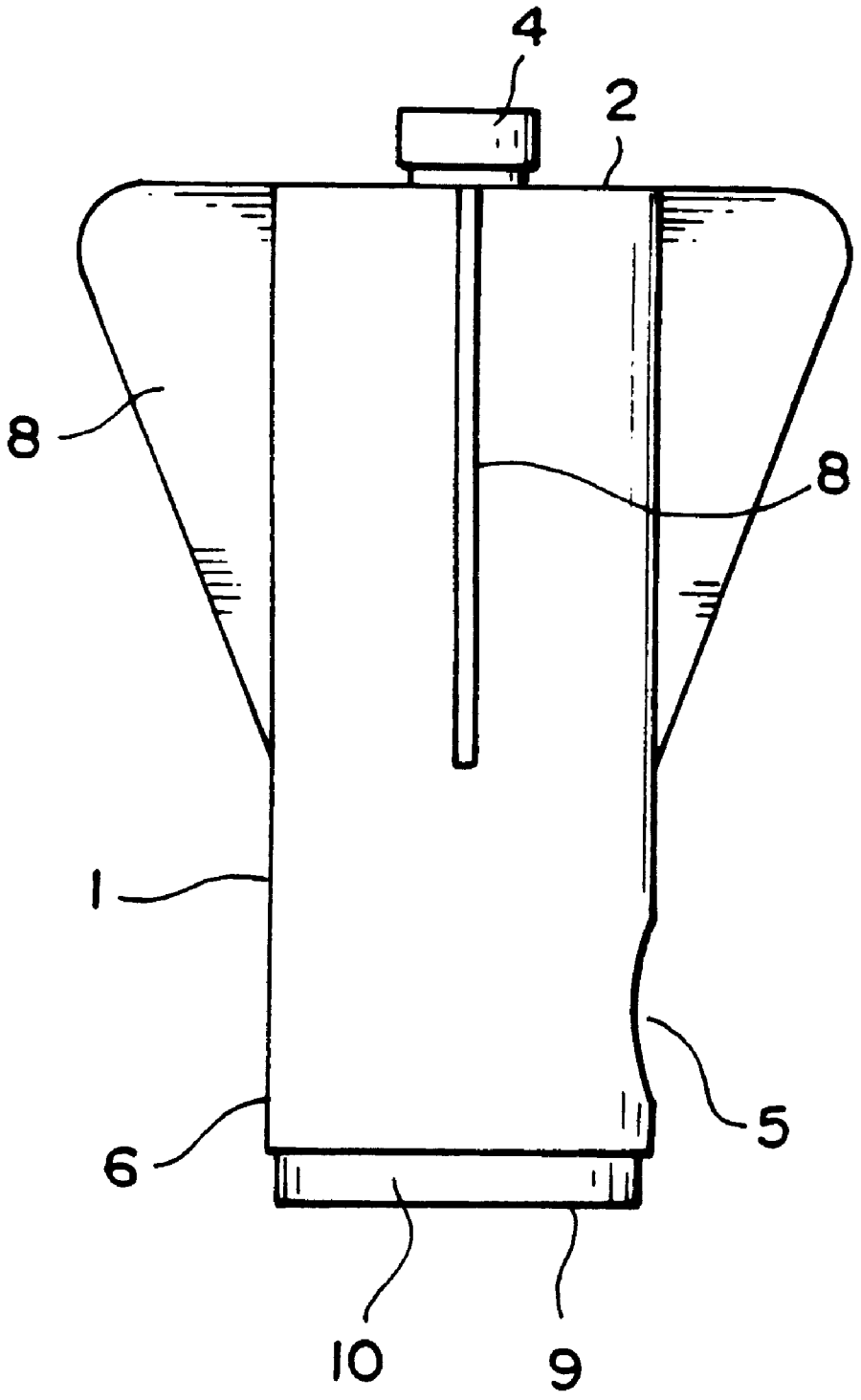
FIG. 2 is a side view illustrating the back body thereof.
Figure 3:
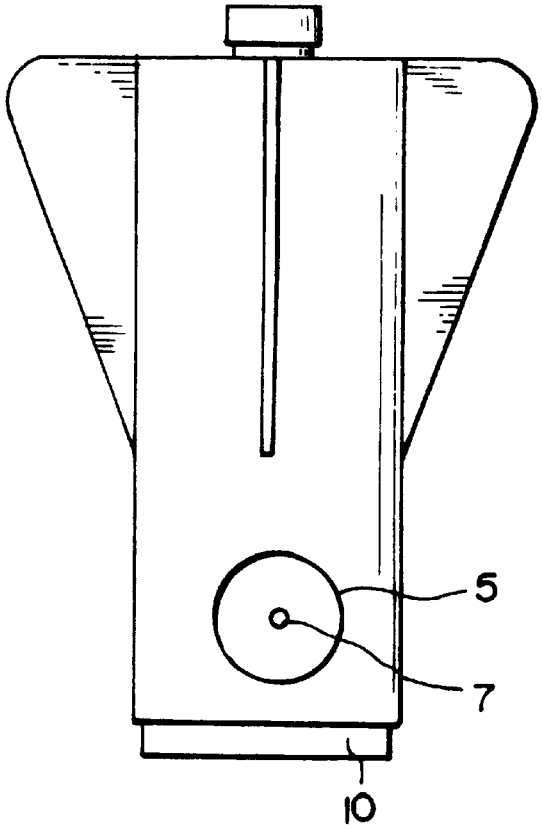
FIG. 3 is a side view of the same back body as above watched from another angle.
Figure 4:
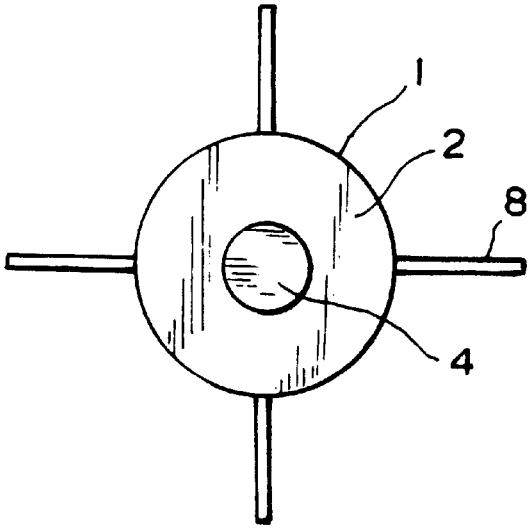
FIG. 4 is a plan view of the same back body watched from the back side.
Figure 5:
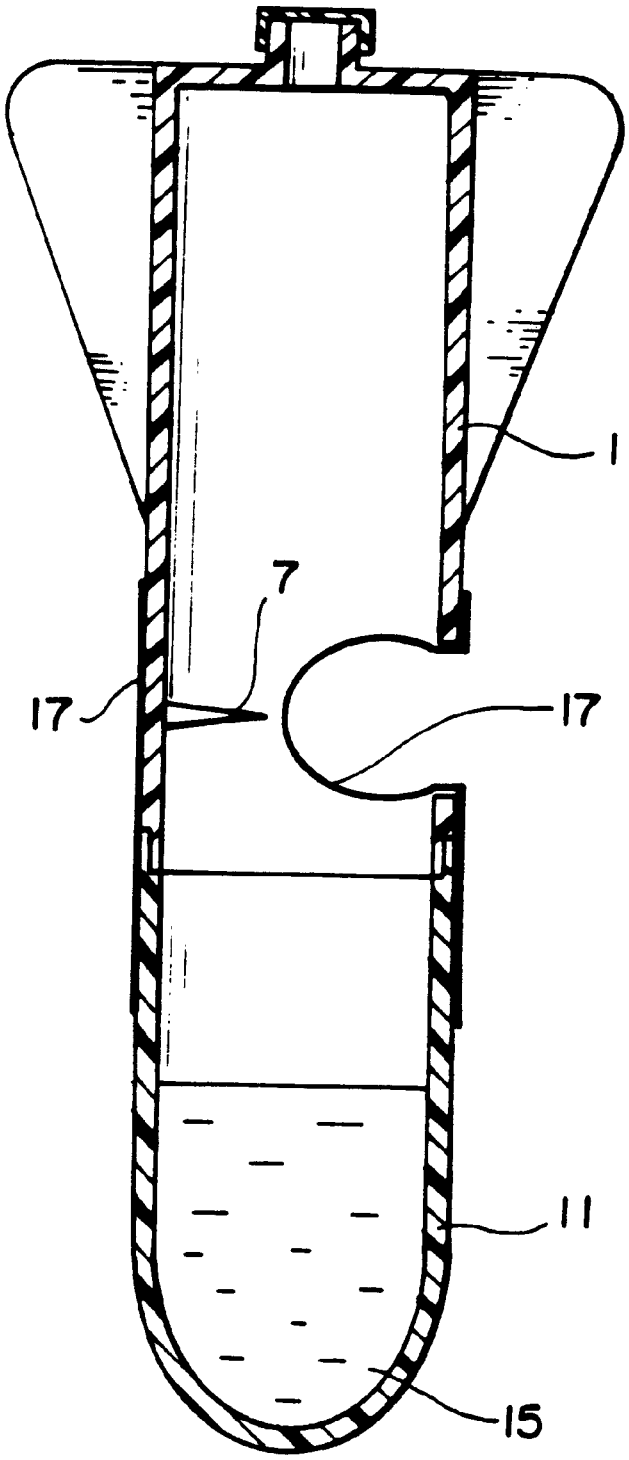
FIG. 5 is a longitudinal sectional view of the throwing good illustrating the state just before disintegration thereof.
Figure 6:
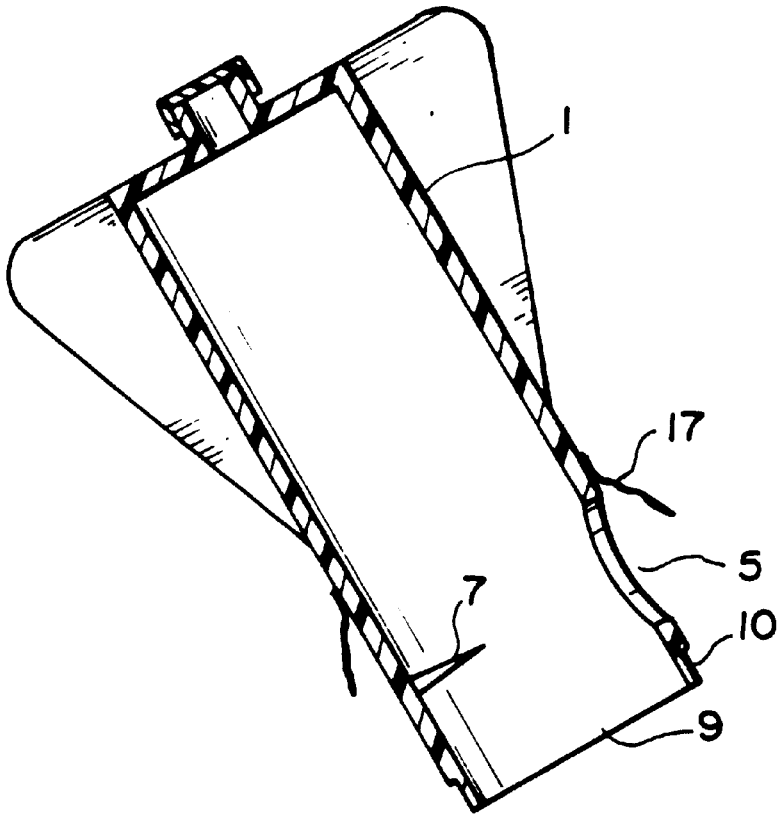
FIG. 6 is a longitudinal sectional view illustrating the state just after disintegration thereof.
Figure 6:
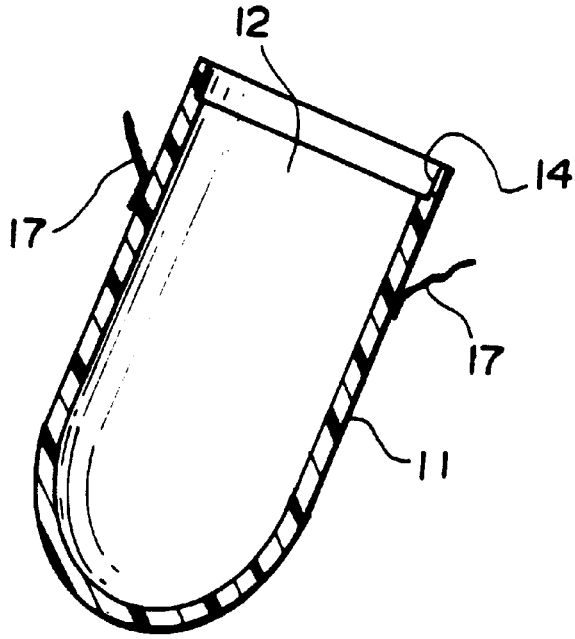

In FIG. 1, 1 is a light-weight back body which is a thin-gage cylinder having bottom 2 and is formed of a synthetic resin. At the center of the bottom 2, there is provided a small hole 3 which can be opened and closed at will by means of plug 4. On the wall 6 close to the front opening 9 of the back body 1, there is provided a roughly circular opening window 5 whose inner diameter $D_2$ is approximately a half of the diameter $D_1$ of the back body 1. On the inner surface of the wall 6 confronting the opening window 5, there is provided a needle 7 directed toward the opening window 5. The height of the needle 7 is roughly a half of the inner diameter $D_1$. To the wall 6 close to the back end of the back body 1, there are attached triangular stabilizing fins 8. Further, step 10 having a lessened diameter is provided on the wall of the front opening 9 of the back body 1. On the other hand, in FIG. 1, 11 is cylindrical front body which is a synthetic resin-made body having a small wall thickness and having the same diameter as that of the back body 1. The front tip 16 of the front body 11 is shaped into a hemisphere, and step 14 fitting with the step 10 of the back body 1 is formed on the wall 13 of the back opening 12. In FIG. 1, 15 is the ballast water filled for the purpose of controlling the fall rate of the throwing good. The water is introduced from the small hole 3 after taking out the plug 4. Thereafter, back body 1 and front body 11 are joined together by means of respective steps 10 and 14, and integrated by covering the walls 6 and 13 with a rubber band 17 having a broad width. The rubber band 17 has so large a width that it can cover the opening window 5 of the back body 1 simultaneously, and the opening window 5 is clogged by the rubber band 17. Accordingly, this throwing good is in an air-tight state in which the inner atmosphere is intercepted from the outer atmosphere. Next, the method for using the throwing good will be explained. At first, the weight of the throwing good is controlled by filling water therein so that its fall rate becomes comparable to the fall rate of sky diver. Just before jumping out of airplane, the plug 4 is once opened in the sky to balance the inner pressure with the outer pressure. Then, the sky diver jumps out of airplane while carrying the throwing good, and a plurality of sky divers play catch ball using the throwing good as if it were a ball, in the process of free fall. When the divers approach a height where parachute must be opened (about 3,000 feet), the diver catches and recovers the throwing good, opens his parachute while carrying the throwing good on his body or in his hand, and lands. After the parachute is opened, the plug 4 is again opened to balance the inner pressure with the outer pressure. On the other hand, when the diver fails to catch the throwing good, the throwing good continues a free fall, during which the outer pressure rapidly becomes higher than the inner pressure as the throwing good drops, so that the rubber band 17 covering the opening window 5 begins to expand toward inside as shown in FIG. 5, until the rubber band touches the tip of needle 7 and is broken thereby. Due to breakage of the rubber band 17, the back body 1 and the front body 11 are separated from each other as shown in FIG. 6, the ballast water 15 present therein flies away, and the good forms two light-weight bodies flutteringly falling from the sky. Therefore, the two bodies thus formed do not crash against the ground surface nor give damage to human being and structures provided on the ground surface. The height where divers jump out of airplane is usually 12,000 feet. At this height, the atmospheric pressure is about 480 mm Hg, which is only 7/10 of the pressure at a height of 3,000 feet where parachute is opened. It is doubtless that the expansion and breakage of the rubber band 17 can be surely achieved by utilizing this great difference in atmospheric pressure. After the diver has succeeded in catching the throwing good, he must open the plug to balance the inner pressure with the outer pressure in order to prevent expansion and breakage of the rubber band. For the sake of omitting this operation, a valve mechanism may be provided instead of the simple plug so that a mere pushing of the valve is enough to make a balance between the inner and outer atmospheric pressures, if desired. The height at which the rubber band 17 breaks varies according to the length of needle 7, in such a manner that the breakage occurs at a lower height when a needle which has a shorter length is used. Usually, the length of the needle is preset so that breakage of rubber band 17 takes place at a height of 2,000 feet from the ground surface. A structure for making the needle length variable is convenient because the height of breakage of rubber band 17 can be controlled thereby at will.

As has been mentioned above, the throwing good of the present invention is so constructed as to cause disintegration of the throwing good in the sky by utilizing the expansion of rubber band 17 accompanying the change in atmospheric pressure. Since no expensive devices such as manometer and timer is used therein, it can be manufactured quite inexpensively, and a sky diver can dispose it without great economical burden. On the other hand, it can work surely with almost no danger of crashing against ground surface, so that it can sufficiently contribute to the safety of sky diving.

What is claimed is:

1. A throwing good for use in sky diving comprising:

a thin-gage, synthetic resin-made back body having a bottom and having a cylindrical shape, said bottom having a small hole which can be opened and closed at will by means of a plug, a roughly circular opening window provided on the wall close to the front opening of the back body, a needle directed toward the opening window protruded from the inner wall confronting the opening window, a front body having the same diameter as that of the back body of which back opening has a tip shaped into a hemisphere, the back opening of the front body being joined to the front opening of the back body and the joining portion being integrated by covering it with a rubber band of broad width capable of covering even the opening window, and ballast water filled therein.

* * * * *